US005461741A

United States Patent [19]

Graebe

[11] Patent Number: 5,461,741

[45] Date of Patent: Oct. 31, 1995

[54] MODULAR CUSHION CONSTRUCTION WITH FOAMED BASE

[76] Inventor: Robert H. Graebe, St. Clair County, Ill.

[21] Appl. No.: 332,934

[22] Filed: Oct. 31, 1994

Related U.S. Application Data

[62] Division of Ser. No. 53,551, Apr. 27, 1993, abandoned, which is a continuation of Ser. No. 839,305, Feb. 20, 1992, abandoned.

[51] Int. Cl.[6] ..... A47C 27/18; A47C 27/10; A61G 7/057

[52] U.S. Cl. ..... 5/654; 5/653; 297/284.3; 297/284.6; 297/464; 297/452.41

[58] Field of Search ..... 5/654, 653, 449, 5/455, 468, 481, 448, 900.5; 297/DIG. 1, DIG. 3, 284.1, 284.3, 284.6, 452.21, 452.26, 452.41; D6/596, 601

[56] References Cited

U.S. PATENT DOCUMENTS

| | | | |
|---|---|---|---|
| D. 294,212 | 2/1988 | Sias et al. | D6/601 |
| D. 335,235 | 5/1993 | Hildreth | 5/653 |
| 658,789 | 10/1900 | Legg | 5/500 |
| 2,800,165 | 7/1957 | Talalay et al. . | |
| 2,970,638 | 2/1961 | Halter | 297/460 |
| 3,258,791 | 7/1966 | Kaplan | 5/901 |
| 3,376,070 | 4/1968 | Johnson . | |
| 3,468,311 | 9/1969 | Gallagher | 5/455 |
| 3,605,145 | 9/1972 | Graebe | 5/455 |
| 3,822,425 | 7/1974 | Scales . | |
| 4,076,872 | 2/1978 | Lewicki et al. | 5/455 |
| 4,164,798 | 8/1979 | Weber . | |
| 4,399,574 | 8/1983 | Shuman | 5/900.5 |
| 4,424,599 | 1/1984 | Hannouche . | |
| 4,485,505 | 12/1984 | Paul . | |
| 4,541,136 | 9/1985 | Graebe . | |
| 4,605,582 | 8/1986 | Sias et al. . | |
| 4,614,000 | 9/1986 | Mayer | 5/455 |
| 4,643,481 | 2/1987 | Saloff et al. . | |
| 4,673,605 | 6/1987 | Sias et al. | 5/464 |
| 4,682,818 | 7/1987 | Morell . | |
| 4,698,864 | 10/1987 | Graebe . | |
| 4,726,624 | 2/1988 | Jay . | |
| 4,730,610 | 3/1988 | Graebe . | |
| 4,741,057 | 5/1988 | Rosier et al. | 5/455 |
| 4,744,351 | 5/1988 | Grundei et al. | 5/465 |
| 4,753,480 | 6/1988 | Morell . | |
| 4,796,948 | 1/1989 | Paul et al. . | |
| 4,809,374 | 3/1989 | Saviez . | |
| 4,866,800 | 9/1989 | Bedford . | |
| 4,893,873 | 1/1990 | Iwamoto et al. . | |
| 4,953,913 | 1/1990 | Graebe . | |
| 5,018,790 | 5/1991 | Jay . | |
| 5,052,068 | 10/1991 | Graebe . | |
| 5,079,790 | 1/1992 | Pouch . | |
| 5,152,023 | 10/1992 | Graebe | 5/455 |
| 5,153,956 | 10/1992 | Nold | 5/481 |
| 5,163,737 | 11/1992 | Navach et al. | 5/653 |
| 5,176,424 | 1/1993 | Tobita et al. | 297/DIG. 1 |
| 5,317,773 | 6/1994 | Grarbe | 5/654 |
| 5,369,828 | 12/1994 | Graebe | 5/654 |
| 5,378,045 | 1/1995 | Sirkman et al. | 5/654 |
| 5,395,162 | 3/1995 | Jay et al. | 297/452.41 |

FOREIGN PATENT DOCUMENTS

| | | | |
|---|---|---|---|
| 1030500 | 6/1953 | France | 5/653 |
| 921098 | 3/1963 | United Kingdom | 5/900.5 |
| 1310373 | 3/1973 | United Kingdom | 5/468 |

OTHER PUBLICATIONS

TRI–MAX Information sheet D–8083 dated Jan. 1, 1989.

*Primary Examiner*—Alexander Grosz
*Attorney, Agent, or Firm*—Polster, Lieder, Woodruff & Lucchesi

[57] ABSTRACT

A modular cushion comprising a shaped base which has a flat rear portion and a raised front portion with angularly directed valleys and a raised pommel to direct weight to the thighs and in combination with a resilient pad positioned on the flat portion of the base to relieve pressure on the ischial and trochanters and in combination with a cover having a non-skid undersurface and a portion of the top being two-way stretchable. The resilient pad may be of inflatable cells having a pyramidal shape with a flattened top. A U-shaped restraining member may be positioned at the front of the base with upwardly projecting sides to retain the legs of the user.

36 Claims, 7 Drawing Sheets

FIG. 5.
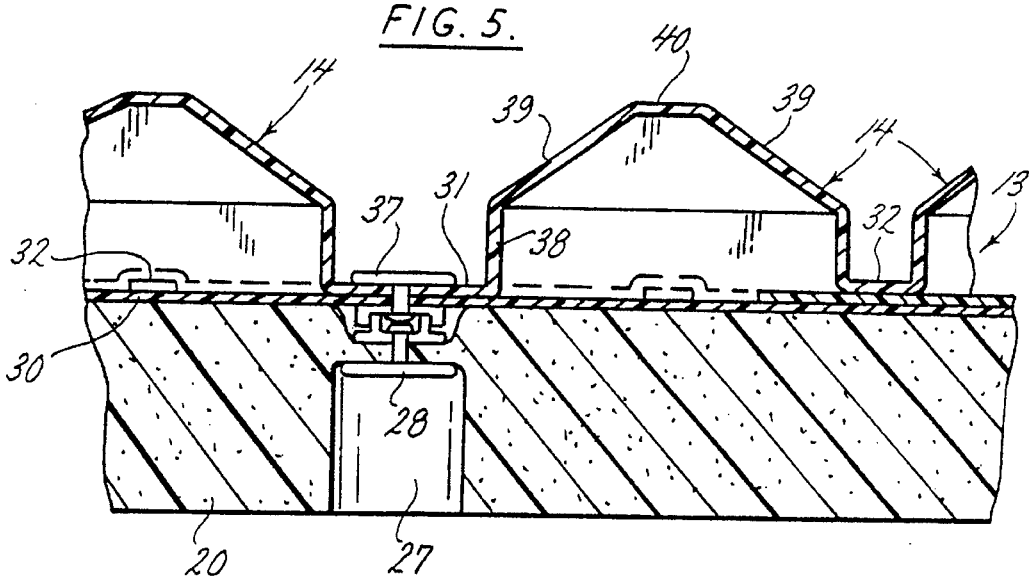
FIG. 7.
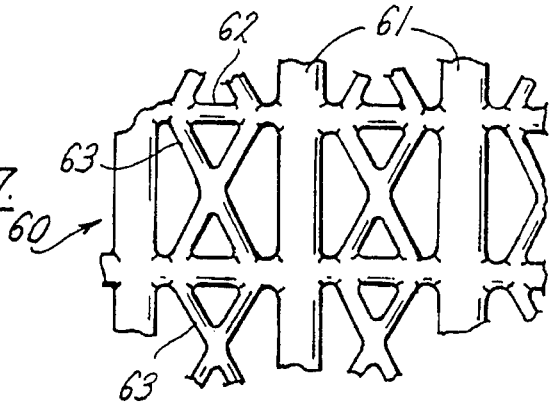
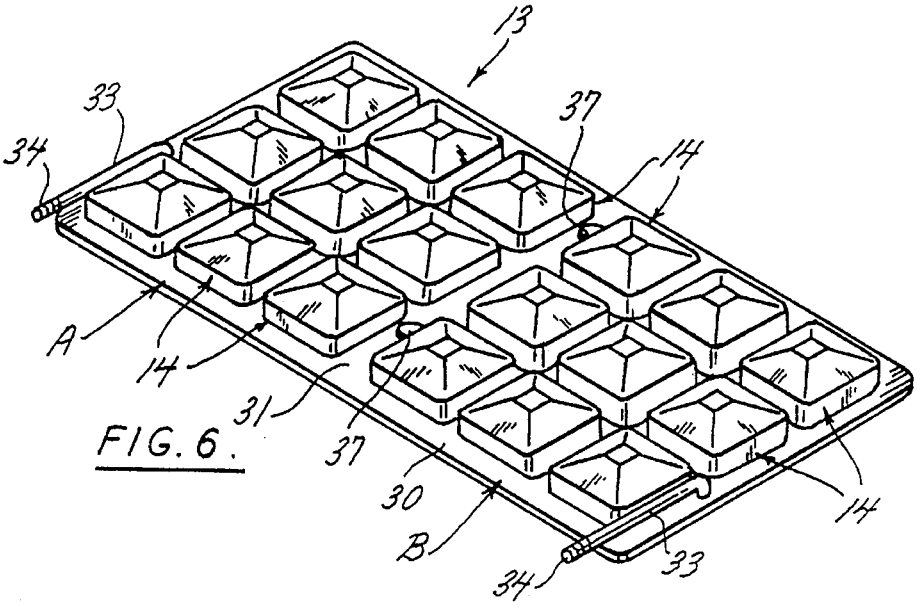
FIG. 6.

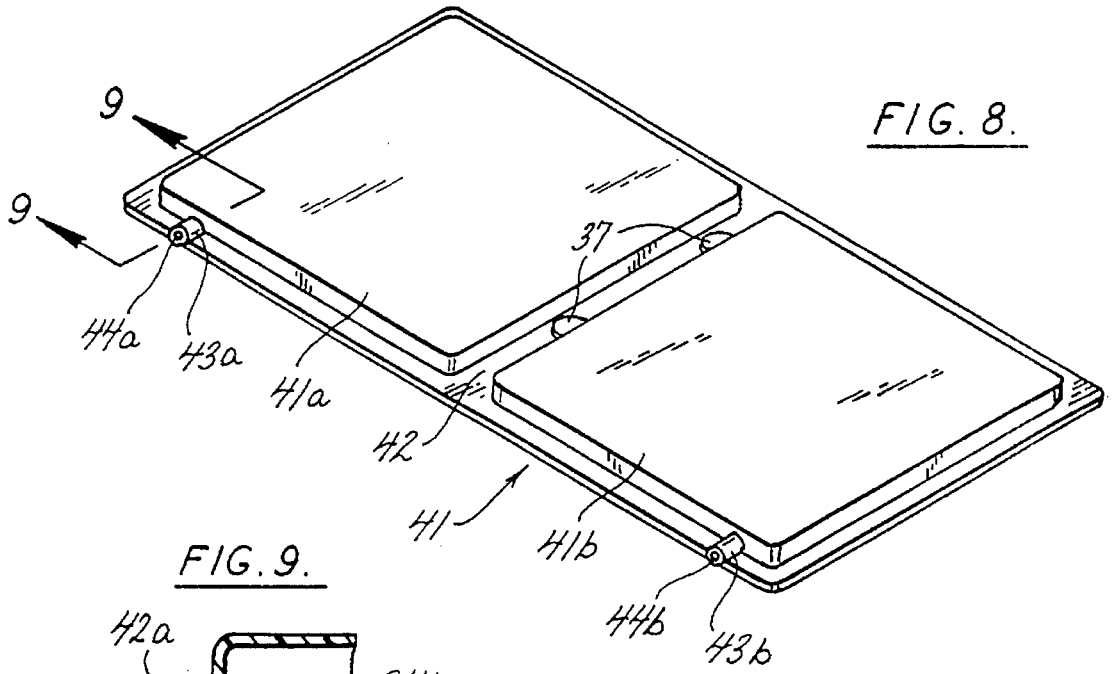
FIG. 8.
FIG. 9.
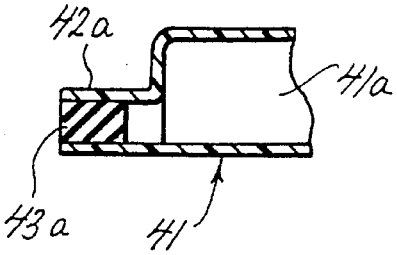
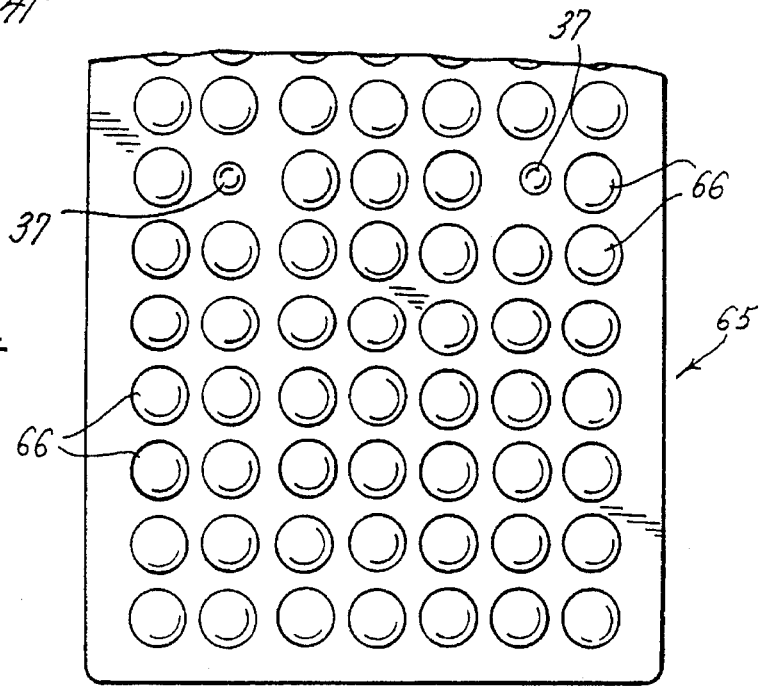
FIG. 10.
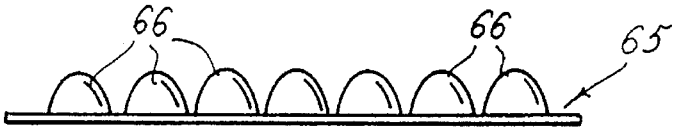
FIG. 11.

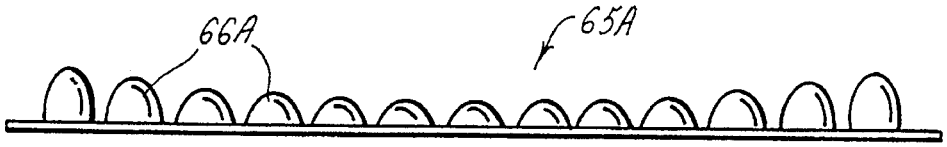
FIG. 11A.
FIG. 18.
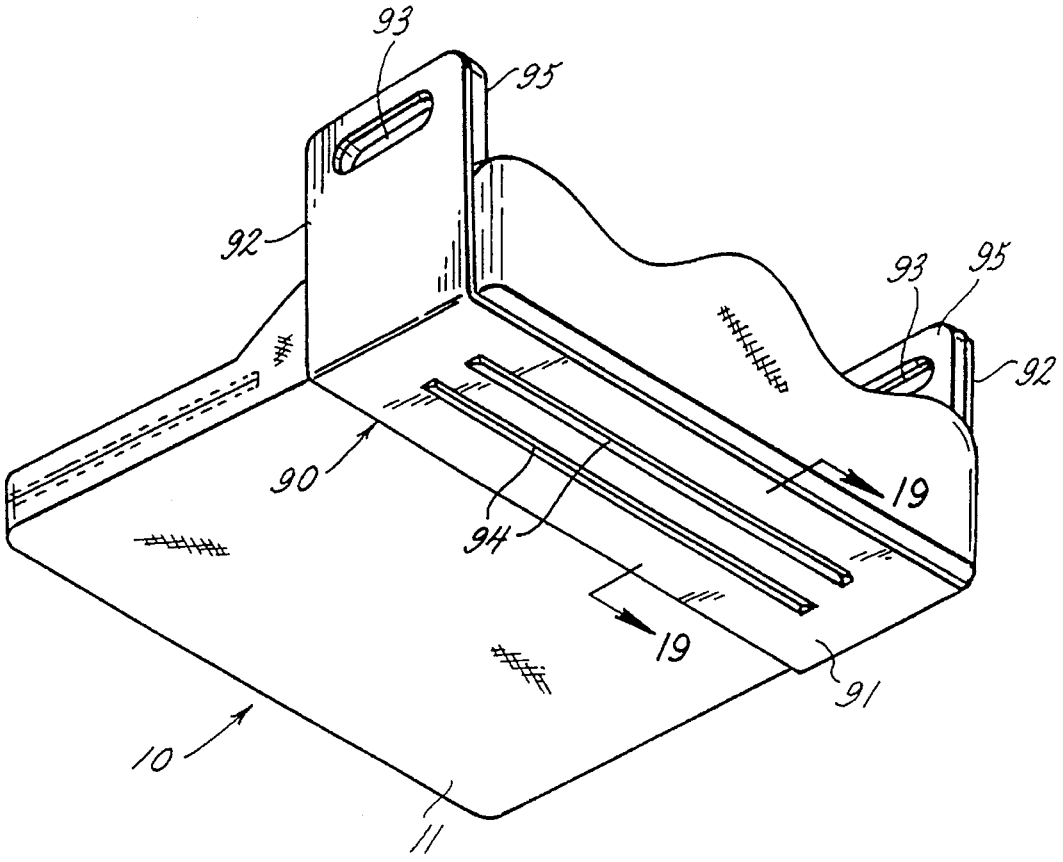
FIG. 19.
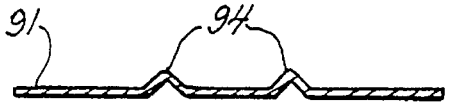

MODULAR CUSHION CONSTRUCTION WITH FOAMED BASE

This is a divisional of application Ser. No. 08/053,551 filed on Apr. 27, 1993, now abandoned, and refiled on Oct. 25, 1994 as application Ser. No. 08/328,551 which is a continuation of application Ser. No. 07/839,305 filed on Feb. 20, 1992, now abandoned for MODULAR CUSHION CONSTRUCTIONWITH FOAMED BASE.

BACKGROUND OF THE INVENTION

This invention relates in general to cushions for seating and more particularly to a modular wheelchair cushion which has a shaped foam base, a fluid filled or foam cellular pad covering part of the base, and a fabric cover enclosing the base and the pad.

Those who must spend extended time in wheelchairs run the risk of tissue breakdown and the development of pressure sores, which are extremely dangerous and difficult to cure. These pressure sores are decubitus ulcers, typically formed in areas where bony prominences exist, such as the ischia, heels, elbows, ears and shoulders. Typically, when sitting much of the individual's weight concentrates in the regions of the ischia, that is at the bony prominences of the buttocks and unless frequent movement occurs, the flow of blood to the skin tissue in these regions decreases to the point that the tissue breaks down. This problem is well known and many forms of cushions are especially designed for wheelchairs for reducing the concentration of weight in the region of the ischia, and these cushions generally seek to distribute the user's weight more uniformly over a larger area of the buttocks.

Another area where problems occur is in the trochanter area and both cushions and bases for the cushions are shaped so that the thighs are loaded and pressure is relieved on the ischia and the trochanters. Still another problem with wheelchair type cushions is stabilization of the user so that he has a feeling of security when sitting in the wheelchair.

A number of patents show cellular cushions which comprise an array of closely spaced air cells which project upwardly from a common base and are interconnected. These cushions combine the most uniform distribution of weight and thus provide the greatest protection from the occurrence of pressure sores. Since the air cells communicate with each other, all exist at the same internal pressure and each air cell exerts essentially the same restoring force against the buttocks, irrespective of the extent to which it is deflected. U.S. Pat. No. 4,541,136 shows a cellular cushion currently manufactured and sold by Roho, Inc. of Belleville, Ill. for use on wheelchairs.

The stability problem has been attacked by the use of shaped bases such as shown in Graebe U.S. Pat. No. 4,953,913 and Jay U.S. Pat. No. 4,726,624. These bases are generally used in conjunction with cushions and Graebe U.S. Pat. No. 4,953,913 has been used in conjunction with a cellular cushion and a fabric cover. The stability problem also has been addressed in the cellular cushion field by the use of zoned areas of inflation as shown in Graebe U.S. Pat. No. 4,698,864 which shows a zoned cellular cushion with cells of varying height and Graebe U.S. Pat. No. 5,052,068 which shows another form of zoned cushions with cells of different heights.

Graebe U.S. Ser. No. 07/723,408, now U.S. Pat. No. 5,111,544 shows a cover for a zoned cellular cushion which keeps the cells from deflecting outwardly. This cover has a stretchable top, a skid resistant base and a non-stretchable fabric side panel area.

The present invention resides in a foamed base having a flat rear area onto which may be fastened a variety of pads, including those which have a shaped surface to conform to body shapes, preferably a pad formed with upstanding air inflated cells. The base has a raised shaped front designed to load the thighs and separate the legs to stabilize the pelvis. A fabric cover forms the outside of the composite cushion and has a portion of the top formed of stretchable material and the remainder of the top and sides formed of a slick non-stretchable fabric with a skid resistant base. The base by itself is useful by able bodied persons who have good tissue bulk around their legs, whereas disabled persons who do not have good thigh bulk benefit by having a fluid filled module, such as an inflated air module, or a suitable foam module installed on the rear area.

The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 5 is a fragmentary sectional view taken along line 5—5 of FIG. 4;

FIG. 6 is a perspective view of the cellular cushion;

FIG. 7 is a fragmentary plan view of a portion of the base of the cover.

FIG. 8 is a fragmentary plan view of another modified cushion;

FIG. 9 is a fragmentary sectional view taken along line 9—9 of FIG. 8;

FIG. 10 is a fragmentary plan view of another modified cushion;

FIG. 11 is an end elevational view of the modification shown in FIG. 10;

FIG. 11A is a rear view of a modification of the cushion shown in FIG. 10;

FIG. 18 is a perspective view of a leg positioner module; and

FIG. 19 is a partial sectional view taken along line 19—19 of FIG. 18.

DETAILED DESCRIPTION

Figure 1:
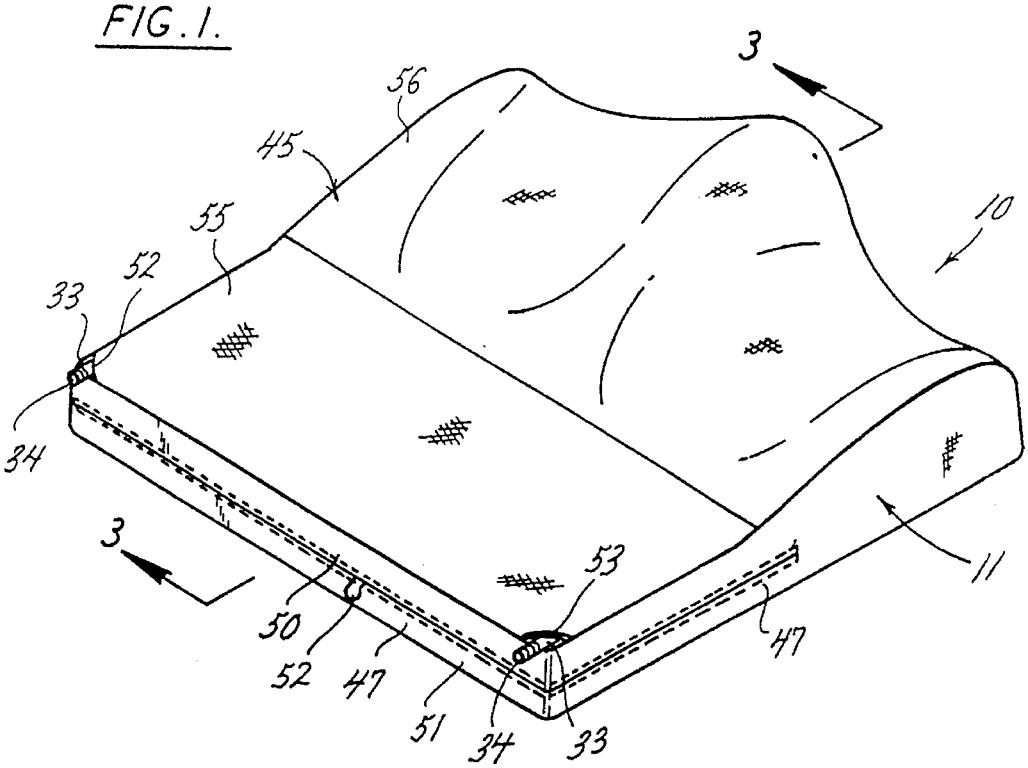
FIG. 1 is a perspective view of the modular cushion of this invention.
Figure 2:
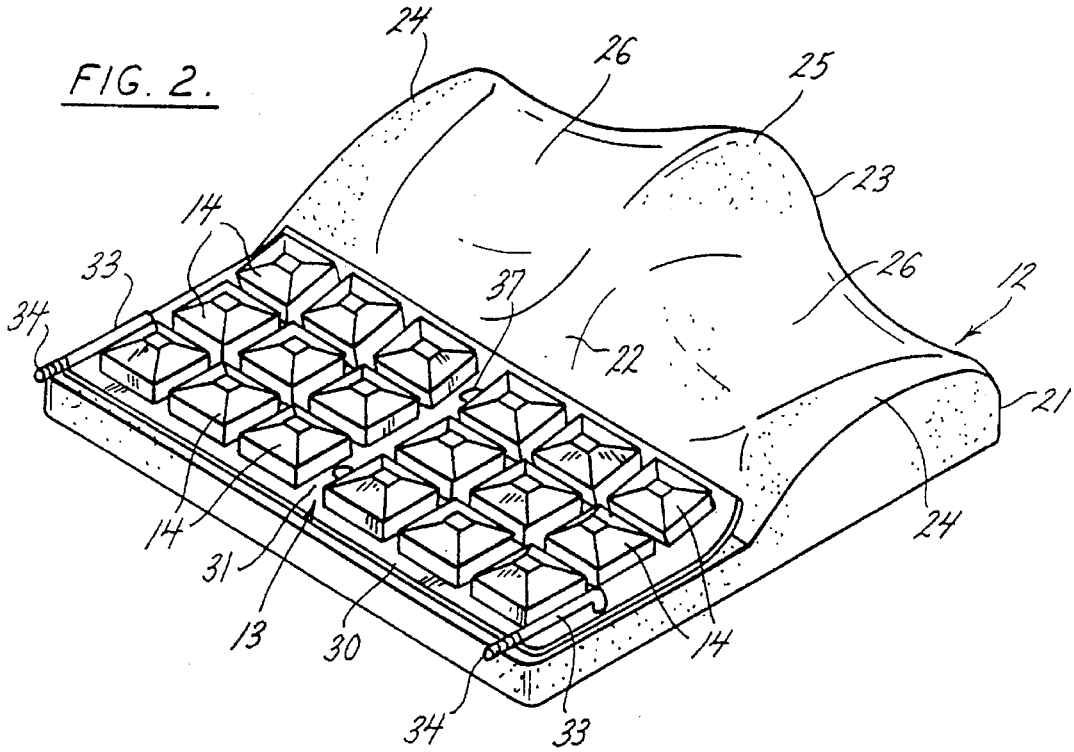
FIG. 2 is a perspective view similar to FIG. 1 with the cover removed and showing only the base and a cellular cushion.

FIGS. 1 and 2 show the preferred form of the composite modular cushion 10 which comprises an outer cover 11 and, as shown in FIG. 2, a shaped base 12 and an inflatable cellular cushion 13 formed with upstanding air cells 14.

Figure 4:
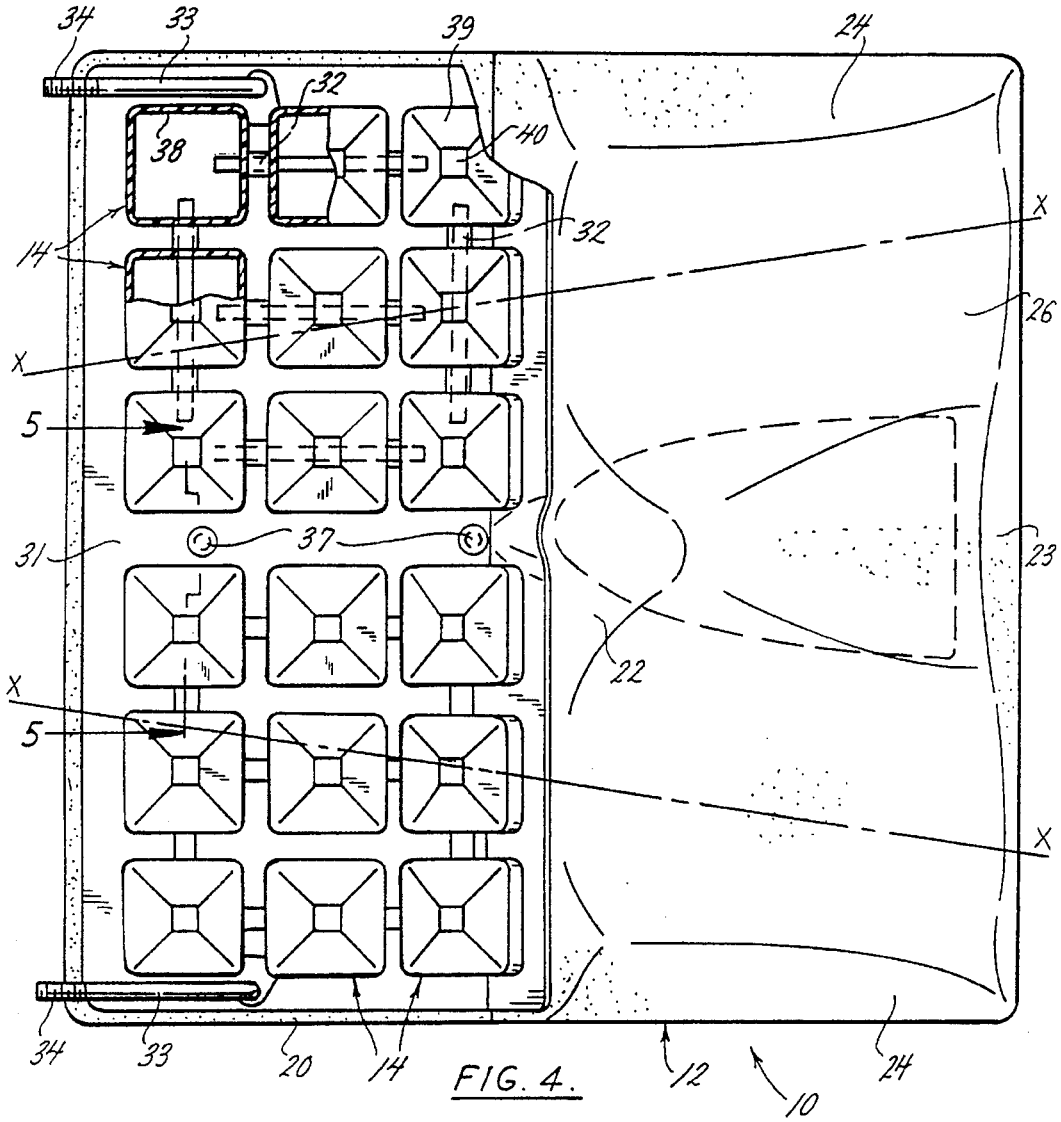
FIG. 4 is a fragmentary plan view with part of the cover broken away.
Figure 3:
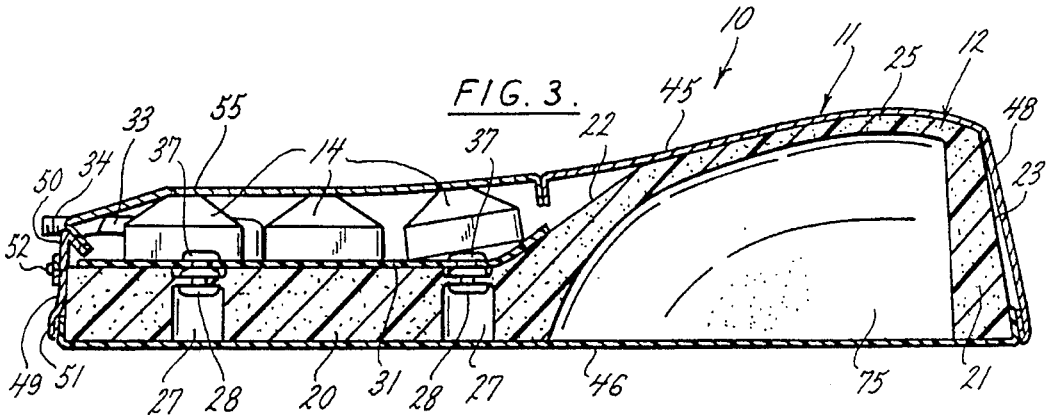
FIG. 3 is a sectional view taken along line 3—3 of FIG. 1.

The base 12 is shown in more detail in FIGS. 2, 3 and 4 and comprises a flat rear area 20 and a raised front area 21. A sloped or inclined connecting area 22 connects the rear area 20 with the front area 21. The sloped connecting area 22 is shown more clearly in FIG. 3. This step down offset is designed to force support to the thighs and relieve pressure to the ischial and the trochanters. The base also includes a tapered front face 23 as seen in FIGS. 3 and 4 and inwardly curved thigh loading areas 24 at the side edges of the front 21. These areas are sloped inwardly from the outer side edges to provide the proper thigh loading characteristics without providing too much pressure against the thighs. In the center of the front area 21 is a raised pommel 25 which is higher than the side areas 24 and is designed to separate the legs, stabilize the pelvis, and to help keep the user from sliding out of his seat. Between the raised side areas 24 and the pommel 25 are dish shaped leg retaining valleys 26 which are angularly inclined outwardly away from the rear base area 20 along the lines X X in FIG. 4 so as to separate the legs in conjunction with the pommel 25.

The base 12 is formed of foamed plastic of polyurethane type and may have various indent densities based on the needs of the user. During molding a skin is formed which is resistant to moisture and chemicals and can be washed and sterilized, if necessary, using conventional techniques.

The underside of the pommel 25 can be hollowed out at 75 to give a softer feel to the center section 25. This is shown in FIGS. 3 and 4. If this feel is not necessary, the hollowed out section 75 may be molded solid with the rest of the base 12. Recesses 27 are molded in selected locations, such as the center of the underside of the flat rear base area 20, and are designed to accommodate the male portion 28 of a snap fastener. The snap fastener is exposed to the top surface of the rear base area 20 so that the air cell module 13 can be attached thereto as will be hereinafter described. Other suitable fastening means such as hook and loop type fasteners of the type sold under the trademark VELCRO can be used where needed, if desired.

Figure 12:
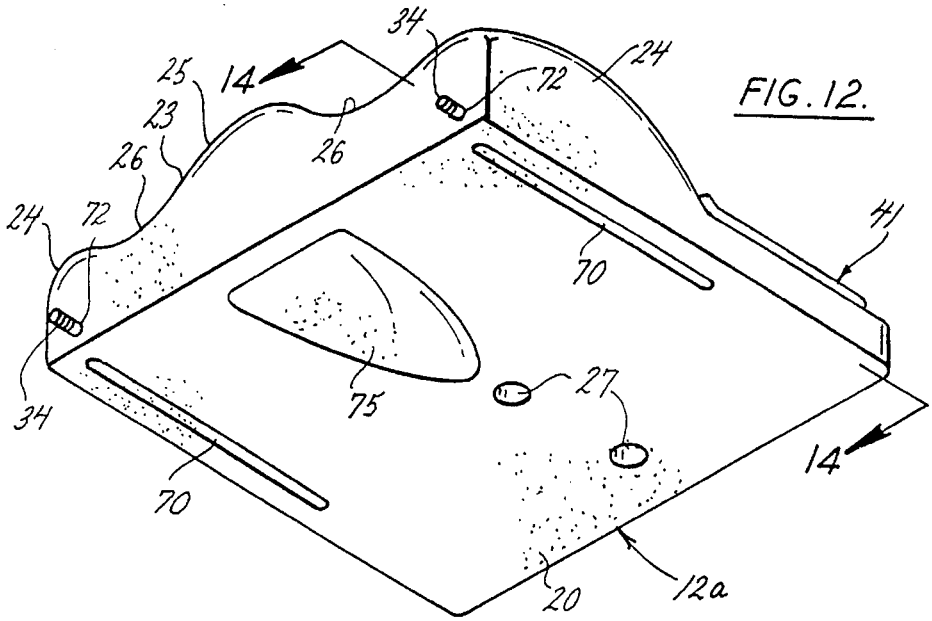
FIG. 12 is a bottom perspective view of a modified base.
Figure 13:
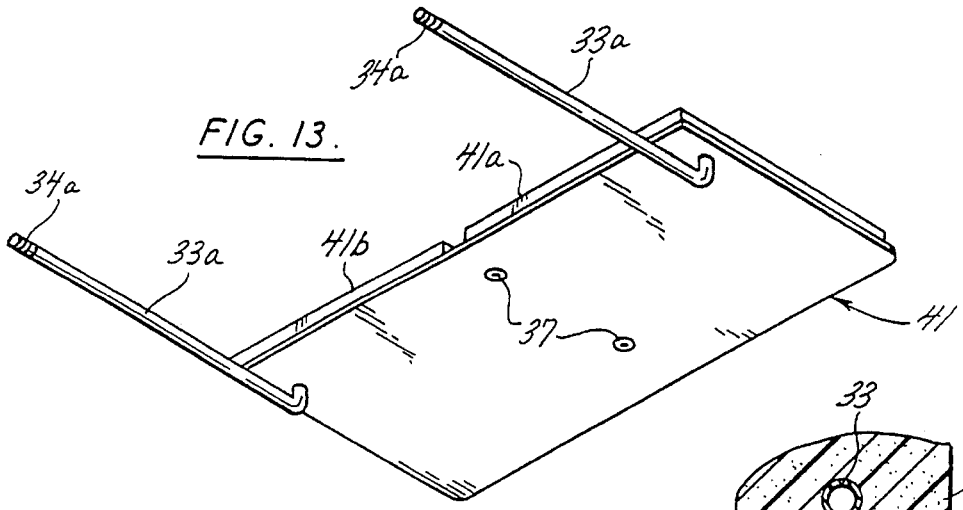
FIG. 13 is a bottom perspective view of a cushion designed to be used with the base shown in FIG. 12.
Figure 15:
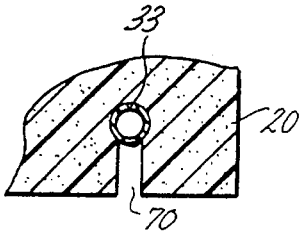
FIG. 15 is a fragmentary sectional view taken along line 15—15 of FIG. 14.
Figure 14:
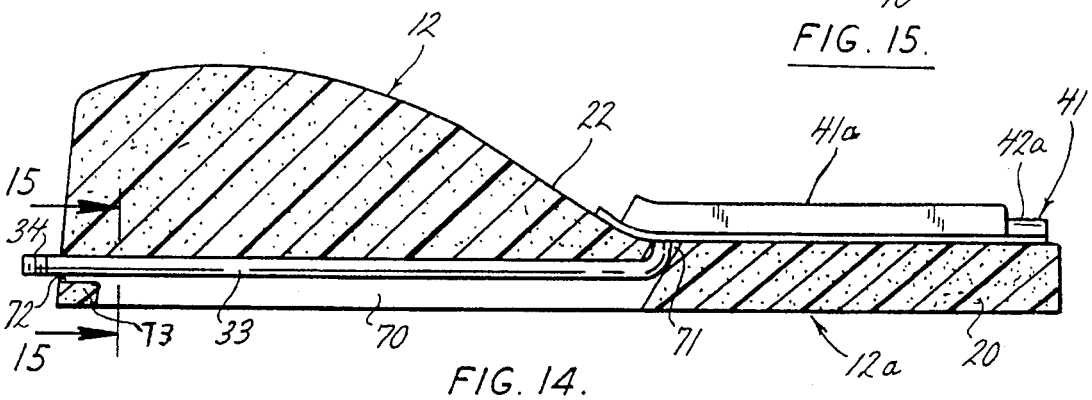
FIG. 14 is a sectional view taken along line 14—14 of FIG. 12.

An alternative construction is shown in FIGS. 12, 14 & 15 in which slots 70 are molded into the underside of the front of the base 12*a*. The slots 70 are parallel to and spaced inwardly from the base side edges and terminate in access openings 71 which open into the top surface of the base 12*a* adjacent to the connecting area 22. The slots 70 terminate short of the base front 23 and also have openings at 72 to the front 23 of the base 12. The solid webs 73 help stabilize the base front 23. The slots 70 accommodate tubes 33*a* for the air inflatable pad 13 so that the air valves 34*a* for the pad 13 are accessible from the front of the cushion 10 whereby they can be inflated and adjusted readily by the user while he is sitting on the modular cushion 10. This can be used with any number of sets of air cells and can be used with the pad of FIG. 2 or the pad of FIG. 8.

The alternative construction also lends itself to the concept of communicating with the undersurface of a module through the base. Using the concept, individual cells can be monitored and a profile of the weight distribution of the user can be determined. This involves a pressure measuring system beyond the scope of this disclosure but the communication with the underside of a cushion through the base makes this possible. The slots 70 may be located to exit at any edge and in any number as may be required.

The inflatable cushion or module 13 has a flexible base 30 of substantially rectangular shape and the air cells 14 project upwardly from the base 30. In the preferred embodiment shown in detail in FIGS. 2–6, there are two zones A and B which are distinct and separated by a center area 31. The air cells 14 in each of the zones A and B are interconnected by means of passages 32. Thus, the air pressure in the cells 14 in each zone is the same but the air pressure in the zones A and B can be different based on the configuration of the patient. Each of the zones has a separate fill tube 33 which has a closure valve 34 on the end thereof. If the fill tube 33 with the closure valve 34 is not used, each of the zones A and B is provided with a test opening connected to one of the air cells 14. This is designed to be closed with a plug which is removable for factory testing and air pressure preshipment adjustment.

These passages 32 may be constructed as described in Graebe U.S. Pat. No. 4,541,136 or may be raised tunnels molded into the top member where the air cells 14 are formed. The tunnels may have a high aspect ratio to exclude glue from the tunnels when the top and base are glued together.

This arrangement is shown and hereinafter described in conjunction with the modification of the invention shown in FIGS. 8 and 9, but also can be used with the pad shown in FIGS. 1–6 or any other variation of the air inflated cellular module.

Positioned through the module base 30 in alignment with the shaped base recesses 27 are the female portions 37 of a snap fastener arrangment. This is shown in FIG. 5 and allows the module 13 to be snapped and fastened to the base 12.

As previously noted the module 13 can be formed from preinflated cells 14 rather than using the fill tube 33. If the fill tube 33 is eliminated, the modules 13 are prefilled at the factory with a predetermined air pressure and this pressure cannot be adjusted by the user. The cells 14 are still interconnected within each zone A and B but the pressure in the zones A and B cannot be adjusted after once being established.

The air cells 14 are of pyramidal shape and have a square bottom, rectangular side edges 38, tapered top side 39 of trapezodial shape, and a substantially flat top 40. The purpose of the pyramid shape is to provide a means to collapse the air cell in a controlled manner during the engagement phase by the person sitting on the points formed by the pyramid. The higher the point the greater the engagement travel which gradually builds up the internal pressure of the cell giving a low force entry zone. This entry zone is especially useful when prefilled or sealed air cells are used. The air cells 14 are spaced from each other by lateral and longitudinal passages 15 and stand independently of each other when erected and filled with air. The inflatable module 13 is formed of a flexible material such as neoprene rubber, or the like.

Other types of snap fastened cushions or pads can be used and several of these are shown in FIGS. 8 and 10. The module 41 of FIGS. 8–9 has two separate inflatable cells 41*a*,41*b* separated by a seam 42 and filled through air valves 43*a*,43*b*. As hereinbefore noted, this form of the invention is shown as having the air chambers 41*a*,41*b* prefilled at the factory with a predetermined air pressure and the fill tubes 43*a*,43*b* are sealed with plugs 44*a*,44*b* which are similar to pencil erasers. Thus, the air pressure in the chamber 41*a*,41*b* cannot be adjusted by the user. As mentioned, this type pad can use the inflation systems shown in FIGS. 1–6 or FIGS. 12–15. Individual sealed cells also can be used in the pad.

A modification of the pad 41 is shown in FIGS. 12–15. This modification is used with the base shown in FIG. 12 and the pad 41 is adjustable from the front. The pad 41 is provided with fill tubes 33*a* which extend from the underside of the pad 41 and are positioned in the base slots 70 so that the fill nozzles 34*a* are accessible from the front to more readily be adjustable by the user. This construction also can be used with the inflatable pad 13 shown in FIG. 1–6.

The cushion 65 shown in FIGS. 10 and 11 is made of a molded foamed plastic and, as shown, has hollow dome shaped members 66 similar to those shown in Sias et al U.S. Pat. Nos. 4,673,605, 4,605,582 and Des. 294,212. The foamed pad 65 can be "T-Foam", molded domes 66, or arch elements as shown in Graebe U.S. Pat. No. 4,713,854, and can be made to better fit the patient by shaping the surface of the foam or adjusting the size or resiliency of the projections. A modification of the cushion 65*a* is shown in FIG. 11A which shows a shaped cushion surface in which the domes 66*a* are of different heights.

The base 12 can be used alone or in combination with any one of the cushions 13, 41, 65 or 65*a*. The base and cushion also can be used in combination with the cover 11.

The cover 11 contains some features in common with Graebe application Ser. No. 07/723,408, filed Jul. 1, 1991, now U.S. Pat. No. 5,111,544 and as shown in FIGS. 1, 3, 4 and 7, includes a top panel 45, a bottom panel 46, side panels 47, a front panel 48 and a rear panel 49. The front, bottom, side, rear and bottom panels are stitched together along their edges to define the cover 11. The respective panels generally conform to the shape of the portions of the shaped base 12 over which they fit. The rear panel 49 is severed into two sections 50,51 which are connected by suitable fastening means, such as a zipper 52, which also can extend into the side panels 47 as far as is necessary to obtain access to the fill valve 33. For example, the zipper 52 can extend completely to a valve stem stored in the sloped wall 22 of the base 12 as described hereinafter in FIGS. 16 and 17. This allows the cover 11 to be slipped over the base 12 and the attached inflatable module 13. It also allows the cover 11 to be removed for cleaning, etc. The rearward ends of the top panel 45 are shortened at the corners to define openings 52,53 through which the fill tubes 33 and valves 34 extend to allow the module 13 to be filled without removing the cover 11. If the fill tube is positioned in the slots 70, the openings 52,53 are at the front edges of the cover 11 to provide access to the fill tubes 33. The top cover 45 is formed of two sections of dissimilar material. The rear section 55 is formed from a highly elastic fabric, i.e., one that stretches in any direction. The elasticity of the top panel 55 enables that panel to conform to the shape of the user's buttocks when the user sits on the inflatable module 13 and minimizes the "membrane effect" of the cover. The top panel section 55 simply follows the contour of the seating surface created by the upper ends 40 of the air cells 14. It detracts little from the capacity of the array of air cells 14 to conform to the shape of the user's buttocks. The forward portion 56 of the top panel 45, the side panels 47, the front panel 48, and the rear panel 49 are formed from a traditional fabric, i.e., one that offers low friction with flexibility, yet is very durable. Typical nylon fabric is suited for this purpose. The forward portion 56 of the top panel 45 offers low friction to aid the user in performing slide transfers on and off the cushion. These sections can be formed from one or more parts and stitched together and stitched to the other panels.

The bottom panel 46 is formed from a high friction mesh 60 (FIG. 7) known as vinyl coated skrim. The mesh 60 consists of polyester fibers woven into an open weave and a polyvinyl chloride coating covering the polyester vinyl fibers without obliterating the openings of the weave. The polyvinyl chloride coating allows the cushion cover 11 to be cleaned and sterilized without causing the fabric coating to become slick and slippery. In other words, it retains its anti-skid or high friction characteristics. The weave of the bottom panel 46 is such that the mesh 60 has relatively thick ribs 61 extending parallel between opposite edges of the panel 46 and thinner connecting segments 62 extending between the ribs 61 and oriented at right angles with respect to the ribs 61, with the spacing between the connecting segments 62 being about the same as the spacing between the ribs 61. This forms a series of square openings which are divided by diagonal segments 63 that extend between the connecting segments 62 and cross at the centers of the square openings. The coating is a high co-efficient of friction against traditional seating surfaces such as wood, metal or fabric, and the friction that develops is particularly affective along the thick ribs 61. The co-efficient of friction between the coating and such surfaces is substantially greater than the co-efficient of friction between the top or side panels 45, 47, 48 and 49 and such surfaces. The mesh 60 is commonly used as an underlayment for throw rugs to prevent them from slipping on traditional flooring materials such as tile, vinyl and hardwood. It may be obtained from Vantage Industries, Inc. of Atlanta, Ga. The high friction mesh 61 of the bottom panel 46 prevents the cover 11, base 12 and module 13 overwhich it fits from sliding over a supporting surface such as the seat of a wheelchair or the seat of a traditional chair or bench. In addition, it admits air to the interior of the cover 11 where the air can circulate through the array of air cells 14. Finally, it permits moisture to drain from the interior of the cover 11.

In use, the cover 11 containing the shaped base 12 and with or without the inflatable module 13 is placed on a supporting surface such as the seat of a wheel chair or a seat of a traditional chair or bench with the bottom panel 46 presented downwardly against the supporting surface. The user's weight is distributed generally uniformly over the portion of the cushion 10 which is defined by the rear section 50 of the top panel 46, i.e., that portion supported by the inflatable module 13. The portion of the user's weight which is supported by that portion of the base 12 which is covered by the front section 56 of the top panel 45 is directed by the shape of the base 12 to the thighs and to relieve pressure on the ischial and the trochanters. The directed contours 26 and the pommel 25 separate the legs and in combination with the new slip cover helps to prevent a user from sliding out of position and the chair seat.

The high co-efficient of friction that exists between the bottom panel 46 and the underlying supporting surface, coupled with the concentration of the user's weight on that panel 46, stabilizes the cover 11 and the encased base 12 and module 13 that is difficult to displace. Indeed, it is practically impossible to slid the combination cover 11, base 12 and module 13 over a traditional wood seating surface without lifting the combination slightly. The bottom panel 46 is rendered particularly effective by reason of the mesh 60 and the thicker ribs 61 within that mesh 60, for it is along the ribs 61 that most of the friction develops with a supporting surface.

Figure 16:
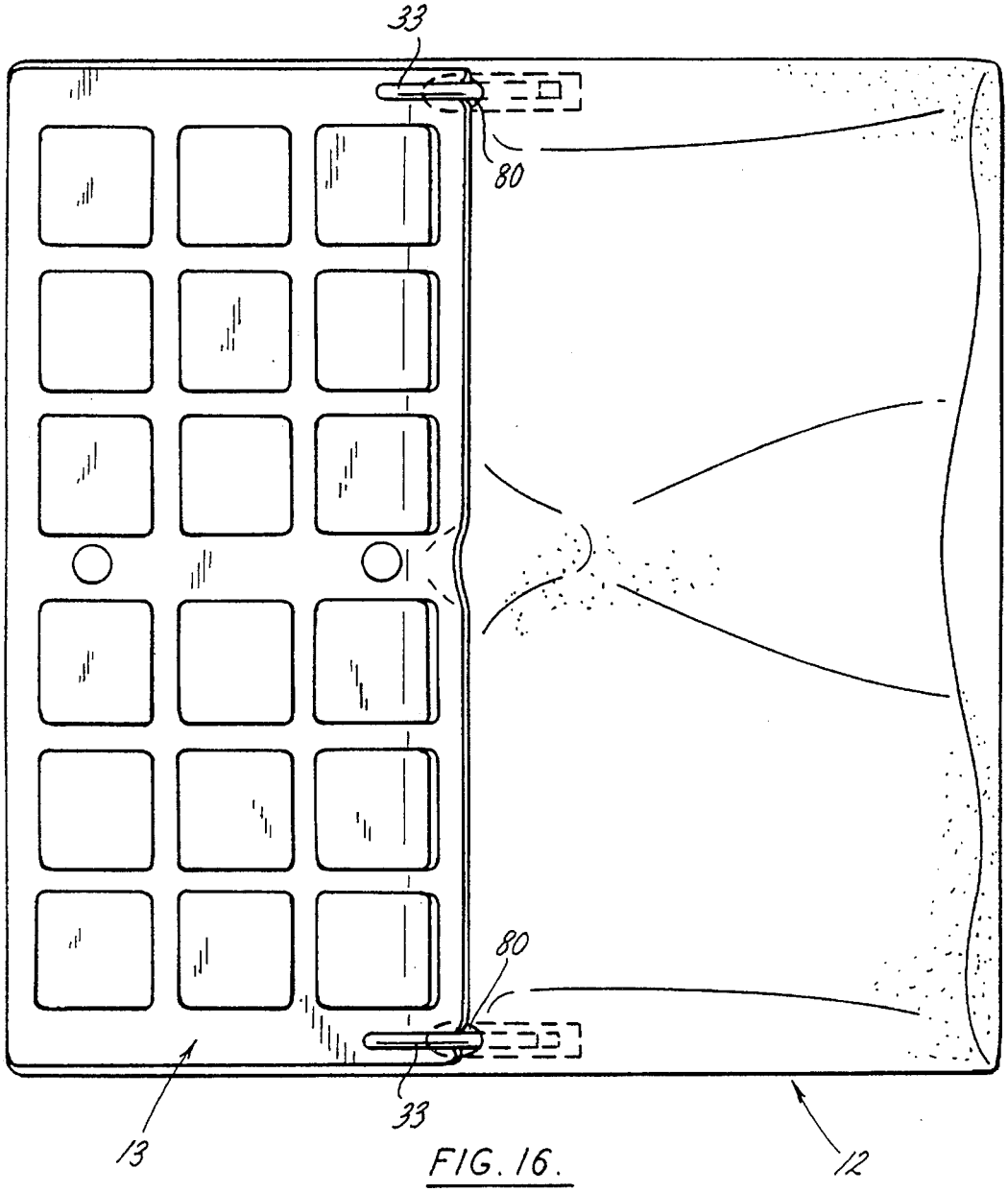
FIG. 16 is a top plan view showing storage of an inflation hose.
Figure 17:
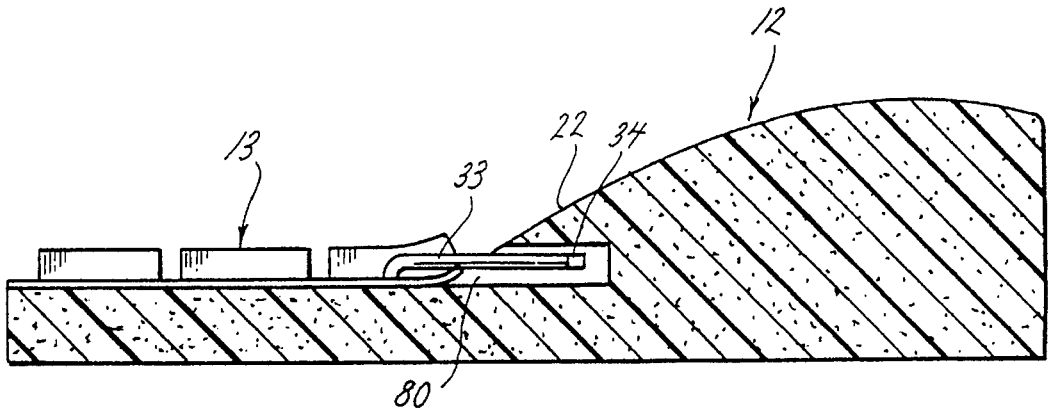
FIG. 17 is a sectional view taken along line 17—17 of FIG. 16 showing storage of an inflation hose.

FIG. 16 shows an alternative construction for the base 12 in which the inflation valve and hose or fill tube 33 is positioned on the front of the pad 13 and is retained in an opening 80 formed in the base 12 and opening at the inclined connecting surface 22. The inflation valve 34 and hose 33 are stored in the opening 80 when not in use. Other type projections on the pad or module 13 can also be inserted into the openings 80 and, if the fit is sufficiently tight, can be used as a means for holding the module 13 in position in lieu of, or in combination with snaps or hook and loops or other fastener.

FIGS. 18 and 19 show another modification of the invention which is a U-shaped retainer 90 positioned on the cushion 10 over the cover 11. The leg positioner and restraint 90 has a base 91 and two upstanding uprights 92 which project upwardly from the front of the base 12. Hand grips 93 can be provided in the free ends of the uprights 92. The base has stiffeners 94 stamped in it to give it rigidity. The leg positioner 90 can be covered with a rubber or vinyl coating, which, in combination with the vinyl coated skrim on the cover 11 will hold the positioner 90 in place. If the positioner 90 is used without a cover 11, VELCRO hook and loop type fasteners or other fastening tape can be used. The uprights 92 flare outwardly slightly and have padding 95 at the top inner surface to help protect the legs of the user.

The structure 90, when placed under the cushion 10, serves as a supplemental leg positioner and restraint to hold the legs of the person toward the center of the cushion 10. The vertical sides 92 are long enough to project beyond the leg to not cause indentation into the flesh. A slight outward flare can be provided on the top portion of the vertical uprights 92 to assure easy and safe entering onto the cushion 10. The hand grip opening 93 can also be provided in each upright 92 to aid in lifting the person or provide a push off purchase to aid in independent transfer off onto the cushion 10.

The leg positioner and restraint 90 is constructed of molded plastic or 1/16" to 1/8" thick aluminum, such as 6061-T6 alloy and can have V-shaped groves 94 along its length to improve its stiffness. The preferred construction will have a vinyl or rubber coating over the metal. Supplemental padding 95 of foam or air filled cushion can be attached by VELCRO hook and loop type fasteners or snaps to the inside of the position sides 92 to further protect the soft tissue of the body.

This invention is intended to cover all changes and modifications of the example of the invention herein chosen for purposes of the disclosure which do not constitute departures from the spirit and scope of the invention.

What is claimed is:

1. A shaped base made from expanded foam having (a) a substantially flat rear portion to accommodate a pad for supporting the buttocks of a user, (b) a raised front portion having a central pommel to separate the legs and side edges which define curved depressed leg areas adjacent to the pommel to place loads on the legs of the user, the depressed leg areas being angularly inclined in a diverging direction toward the front of the base to position the user, and (c) an angularly inclined stepdown section connecting the flat rear portion and the raised front portion to provide a transition which minimizes deformation of the soft tissues of the user which are positioned above this part of the base, (d) said rear portion extending from the back edge of the base to the stepdown section and completely across the base from side-to-side, said rear portion being of substantially uniform thickness throughout.

2. The base of claim 1 wherein the underside of the central pommel is hollowed out to provide a sorer feel to the base in the front central area and integrate a centrally located flat triangular area to accommodate the genitals of a male user.

3. The base of claim 1 including a path through the base connecting the top of the base to the bottom thereof.

4. The base of claim 1 including a pocket positioned in the stepdown section.

5. The base of claim 1 including a path through the base connecting the flat rear portion to the front of the front portion.

6. The base of claim 1 including a U-shaped restraining member positioned at the front of the front section and having sides which project above the side edges to retain the user of the base on the base.

7. A modular cushion combination comprising (a) a shaped base made from expanded foam, the base having (1) a substantially flat rear portion to support a resilient cushion, said rear portion extending across the base from side-to-side and being of substantially uniform thickness throughout, and (2) a raised front portion provided with a central pommel to separate the legs and curved depressed leg areas adjacent to the pommel, the depressed leg areas being angularly inclined in a diverging direction toward the front of the base, and (b) a resilient pad positionable on the flat rear portion of the base, the pad having means for fastening it to the base.

8. The modular cushion combination of claim 7 wherein the raised front portion of the base has raised side edges to load the thighs, an inclined step down section connecting the flat rear portion and the raised front portion to force support to the thighs and relieve pressure to the ischia and the trochanters.

9. The modular cushion combination of claim 7 wherein the pad is an inflatable cushion having areas of upstanding inflatable air cells and the air cells have a pyramidal shaped top with a square base and are separated by longitudinal and lateral spaces.

10. The modular cushion combination of claim 7 wherein the pad is an inflatable cushion having two separate sets of upstanding interconnected air cells with means to independently inflate and adjust each set of cells.

11. The modular cushion combination of claim 7 wherein the pad is a non-inflatable foam pad.

12. The modular cushion of claim 7 wherein the base has the underside of the central pommel hollowed out to provide a softer feel to the base in the front central area.

13. The modular cushion of claim 7 wherein the central pommel of the base is substantially higher than the depressions along each side of the pommel.

14. The modular cushion of claim 7 wherein the means for fastening the cushion to the base are a set of spaced snap fasteners.

15. The modular cushion of claim 7 including a U-shaped restraining member positioned at the front of the base and having sides which project above the sides of the base to retain the legs of the user on the base.

16. The cushion of claim 15 including openings in the sides of the U-shaped member for gripping by the cushion user.

17. The modular cushion combination of claim 7 wherein the pad is an inflatable cushion having two independent cells each of which is monolithic in construction.

18. The modular cushion combination of claim 7 wherein the pad is a non-inflatable pad having a flexible base and formed with upstanding dome shaped spaced pillars.

19. The modular cushion combination of claim 18 wherein the pillars have a rounded top and are of different heights to direct the positioning of the person using the cushion.

20. The modular cushion combination of claim 19 wherein the pillars are highest at the outside lateral edges of the pad and decrease in height toward the center of the pad.

21. A modular cushion combination comprising (a) a shaped base having (1) a substantially flat rear portion extending from a back edge of the base and completely across the base from side-to-side to support a resilient pad and (2) a raised front portion provided with a central pommel to separate the legs and curved depressed areas adjacent to the pommel, (b) a resilient pad positionable on the flat rear portion of the base, the pad having means for fastening it to the base, and (c) a cover positionable over the pad and the base, the cover having a top area with two-way stretch material on the portion of the top which is positioned over the pad, a non-slip bottom, non-stretchable low friction panels connecting the stretchable portion of the top area and the bottom, and means in the cover to open the same to admit the base and pad.

22. A modular cushion combination comprising (a) a shaped base made from expanded foam, the base having (1) a substantially flat rear portion to support a resilient pad, and (2) a raised front portion provided with a central pommel to separate the legs and curved depressed areas adjacent to the pommel, and (b) an inflatable resilient pad positionable on the flat rear portion of the base, the pad having means for fastening it to the base, (c) means in the undersurface of the base for connecting the front of the base to the rear portion and designed to accommodate means for inflating the pad.

23. A modular cushion combination comprising (a) a shaped base made from expanded foam, the base having (1) a substantially flat rear portion to support a resilient pad, and (2) a raised front portion provided with a central pommel to separate the legs and curved depressed areas adjacent to the pommel, and (b) a resilient pad having inflatable cells positionable on the flat rear portion of the base, the pad having means for fastening it to the base, (c) the base being provided with pockets between the front and rear portions to accommodate projections on the pad.

24. The module of claim 23 wherein the projections are nozzles by which the cells on the pad are inflated.

25. A shaped base made from expanded foam having (a) a substantially flat rear portion to accommodate a pad for supporting the buttocks of a user, (b) a raised front portion having a central pommel to separate the legs and side edges which define curved depressed leg areas adjacent to the pommel to place loads on the legs of the user, the depressed leg areas being angularly inclined in a diverging direction toward the front of the base to position the user, (c) an angularly inclined stepdown section connecting the flat rear portion and the raised front portion to provide a transition which minimizes deformation of the soft tissues of the user which are positioned above this part of the base, and (d) a passage from the flat rear portion through the base to the front of the front portion.

26. A shaped base made from expanded foam having (a) a substantially flat rear portion to accommodate a pad for supporting the buttocks of a user, (b) a raised front portion having a central pommel to separate the legs and side edges which define curved depressed leg areas adjacent to the pommel to place loads on the legs of the user, and (c) an angularly inclined stepdown section connecting the flat rear portion and the raised front portion to provide a transition which minimizes deformation of the soft tissues of the user which are positioned above this part of the base, (d) a separable U-shaped restraining member positioned at the front of the front section and having a base member which passes beneath the front of the front section and upstanding side members which engage the sides of the front section and project thereabove to retain the user of the base on the base.

27. The base of claim 26 wherein the depressed leg areas are angularly inclined in a diverging direction toward the front of the base to position the user.

28. The base of claim 26 wherein the sides of the U-shaped member have hand openings therein in the portion which projects above the base.

29. The base of claim 26 wherein the base member has longitudinally strengthening and rigidifying grooves formed therein.

30. The combination of (a) a user supporting base having a top user supporting surface, a bottom, and side walls connecting the user supporting surface to the bottom, and (b) a U-shaped member having upstanding side walls and a bottom wall connecting one end of each of the side walls, said U-shaped member adapted to be positioned beneath and along the sides of said user supporting base, whereby the side members project above the user supporting surface to assist in retaining the user of the base on the base.

31. The combination of claim 30 wherein the sides of the U-shaped member have hand openings therein in the portions which project above the top surface of the base whereby the user can utilize the hand openings in transferring on and off the base.

32. The combination of claim 30 wherein the bottom wall of the U-shaped member has longitudinal grooves formed therein to strengthen and rigidify the U-shaped member.

33. The combination of claim 30 wherein the side walls of the U-shaped member diverge from their areas of connection to the bottom wall.

34. The combination of claim 30 wherein the inside surfaces of the side walls are padded in the areas above the base user supporting surface.

35. The combination of claim 30 wherein the U-shaped member has a protective outer coating.

36. The combination of claim 30 wherein the sides of the U-shaped member diverge and have hand openings therein in the portions which project above the top surface of the base whereby the user can utilize the hand openings in transferring on and off the base, padding on the inner surface of said projecting side portions, longitudinal grooves in the bottom wall of the U-shaped member to strengthen and rigidify, the U-shaped member, and a protective coating on the outer surface of the U-shaped member.

* * * * *